US012270405B2

(12) United States Patent
Miwata et al.

(10) Patent No.: US 12,270,405 B2
(45) Date of Patent: Apr. 8, 2025

(54) VACUUM PUMP AND ROTATING BODY THEREOF

(71) Applicant: Edwards Japan Limited, Yachiyo (JP)

(72) Inventors: Tooru Miwata, Yachiyo (JP); Yoshiyuki Sakaguchi, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 0 days.

(21) Appl. No.: 18/258,886

(22) PCT Filed: Jan. 11, 2022

(86) PCT No.: PCT/JP2022/000594
§ 371 (c)(1),
(2) Date: Jun. 22, 2023

(87) PCT Pub. No.: WO2022/153981
PCT Pub. Date: Jul. 21, 2022

(65) Prior Publication Data

US 2024/0295221 A1 Sep. 5, 2024

(30) Foreign Application Priority Data

Jan. 18, 2021 (JP) ..... 2021-005448

(51) Int. Cl.
*F04D 19/04* (2006.01)

(52) U.S. Cl.
CPC ..... *F04D 19/042* (2013.01)

(58) Field of Classification Search
CPC .. F04D 19/042; F04D 19/04; F16C 2360/045; F05D 2230/90; F05D 2300/611
See application file for complete search history.

(56) References Cited

U.S. PATENT DOCUMENTS

2003/0021672 A1 1/2003 Maejima et al.
2005/0249618 A1* 11/2005 Nonaka ..... F04D 19/04 417/423.4
2007/0031270 A1 2/2007 Maejima et al.
(Continued)

FOREIGN PATENT DOCUMENTS

JP 2018084191 A * 5/2018 ..... F04D 19/042
WO 2005028874 A1 3/2005

OTHER PUBLICATIONS

Otachi, et al., "Vacuum Pump, Its Rotor, Stator Blades, and Process of Manufacture of Them," May 31, 2018, Japanese Patent Office (Year: 2018).*

(Continued)

*Primary Examiner* — Woody A Lee, Jr.
*Assistant Examiner* — Joshua R Beebe
(74) *Attorney, Agent, or Firm* — Shumaker & Sieffert, P.A.

(57) ABSTRACT

There are provided a vacuum pump which can effectively prevent stress corrosion cracking of a rotating body and has excellent corrosion resistance, and a rotating body of the vacuum pump. In a vacuum pump (e.g., a turbo-molecular pump 100) exhausting gas by rotation of a rotating body 103, the rotating body 103 has, on a surface thereof, a first area 1 covered with a first surface treatment layer 1A and a second area 2 covered with a second surface treatment layer 2A, and a boundary portion 3 between the first area 1 and the second area 2 has an area in which the surface treatment layers 1A and 1B of the first and second areas 1 and 2 overlap each other.

8 Claims, 7 Drawing Sheets

(56) References Cited

U.S. PATENT DOCUMENTS

| | | | | |
|---|---|---|---|---|
| 2013/0309076 | A1* | 11/2013 | Nonaka | F04D 29/02 415/200 |
| 2015/0063993 | A1* | 3/2015 | Tsutsui | F04D 19/042 415/200 |
| 2018/0058478 | A1* | 3/2018 | Kimura | F04D 29/662 |

OTHER PUBLICATIONS

International Search Report and Written Opinion of International Application No. PCT/JP2022/000594, dated Mar. 8, 2022, 10 Pages.
Extended Search Report from counterpart European Application No. 22739388.1 dated Jan. 22, 2025, 9 pp.

* cited by examiner

VACUUM PUMP AND ROTATING BODY THEREOF

This application is a U.S. national phase application under 35 U.S.C. § 371 of international application number PCT/JP2022/000594 filed on Jan. 11, 2022, which claims the benefit of JP application number 2021-005448 filed on Jan. 18, 2021. The entire contents of each of international application number PCT/JP2022/000594 and JP application number 2021-005448 are incorporated herein by reference.

TECHNICAL FIELD

The present disclosure relates to a vacuum pump which is used as a means for exhausting gas in a process chamber and other chambers in a semiconductor manufacturing apparatus, a flat panel display manufacturing apparatus, or a solar panel manufacturing apparatus, and a rotating body of the vacuum pump, and particularly relates to a vacuum pump which can effectively prevent stress corrosion cracking of a rotating body and has excellent corrosion resistance, and a rotating body of the vacuum pump.

BACKGROUND

A vacuum pump e.g., a turbo-molecular pump, has a structure in which gas is exhausted by rotation of a rotating body (e.g., a pump rotor) including a plurality of moving rotor blades.

Incidentally, in the conventional vacuum pump, by providing a black Ni plating surface treatment layer (S1) and an Ni plating surface treatment layer (S4) on a surface of the rotating body (pump rotor), different emissivities are provided on the surface of the rotating body, and prevention of corrosion of the rotating body by process gas is intended.

SUMMARY

The present disclosure has been made to provide a vacuum pump which can effectively prevent stress corrosion cracking of a rotating body and has excellent corrosion resistance, and a rotating body of the vacuum pump. In contrast, for a conventional vacuum pump, an area in which a base material of the rotating body (pump rotor) is exposed, is present in a boundary portion between the black Ni plating surface treatment layer (S1) and the Ni plating surface treatment layer (S4), and countermeasures against corrosion of the base material in such a boundary portion are not taken, hence it may be difficult to effectively prevent stress corrosion cracking of the rotating body.

In order to achieve the above object, the present disclosure is a vacuum pump exhausting gas by rotation of a rotating body, wherein the rotating body has, on a surface thereof, a first area covered with a first surface treatment layer and a second area covered with a second surface treatment layer, and a boundary portion between the first area and the second area has an area in which the surface treatment layers of the first and second areas overlap each other.

In the present disclosure, the rotating body may be formed to have a shape in which a rotor blade is formed on an outer peripheral portion of a cylindrical portion, and the boundary portion may be positioned on an inner surface of the cylindrical portion.

In the present disclosure, the boundary portion may be positioned in a vicinity of an end portion of the inner surface of the cylindrical portion.

In the present disclosure, a rotor shaft may be attached to a center of the rotating body via a fastening portion, a tip portion of the rotor shaft may be fitted in a first hole on a side of the rotating body in the fastening portion, and the boundary portion may be positioned in an opening edge portion of the first hole or a portion around the opening edge portion of the first hole.

In the present disclosure, a recess portion corresponding to the boundary portion may be provided in a surface of a member facing the opening edge portion of the first hole or the portion around the opening edge portion of the first hole.

In the present disclosure, a first hole for fitting of a tip portion of a rotor shaft may be provided in a center of the rotating body, and the boundary portion may be absent on an inner surface of the first hole.

In the present disclosure, a rotor shaft may be attached to a center of the rotating body via a fastening portion, a bolt for fastening the rotating body and the rotor shaft to each other may be inserted from a second hole on a side of the rotating body in the fastening portion, and the boundary portion may be positioned on an inner surface of the second hole.

In the present disclosure, the first area may be provided on an outer surface of the cylindrical portion and a surface of the rotor blade, and the second area may be provided on the inner surface of the cylindrical portion.

In the present disclosure, an emissivity of the second surface treatment layer may be higher than an emissivity of the first surface treatment layer.

In addition, the present disclosure is a rotating body of a vacuum pump exhausting gas, the rotating body including on the surface thereof: a first area covered with a first surface treatment layer; and a second area covered with a second surface treatment layer, wherein a boundary portion between the first area and the second area has an area in which the surface treatment layers of the first and second areas overlap each other.

In the present disclosure, as a specific configuration of the vacuum pump and the rotating body of the vacuum pump, the configuration is adopted in which the rotating body has the first area covered with the first surface treatment layer and the second area covered with the second surface treatment layer on the surface of the rotating body and the boundary portion between the first area and the second area has the area in which the surface treatment layers of the first and second areas overlap each other, and hence, in the respect that a base material of the rotating body is not exposed in the boundary portion and the exposed base material may be scarcely exposed to corrosive gas, it is possible to provide the vacuum pump which can effectively prevent the stress corrosion cracking of the rotating body and has excellent corrosion resistance, and the rotating body of the vacuum pump.

DETAILED DESCRIPTION

Figure 1:
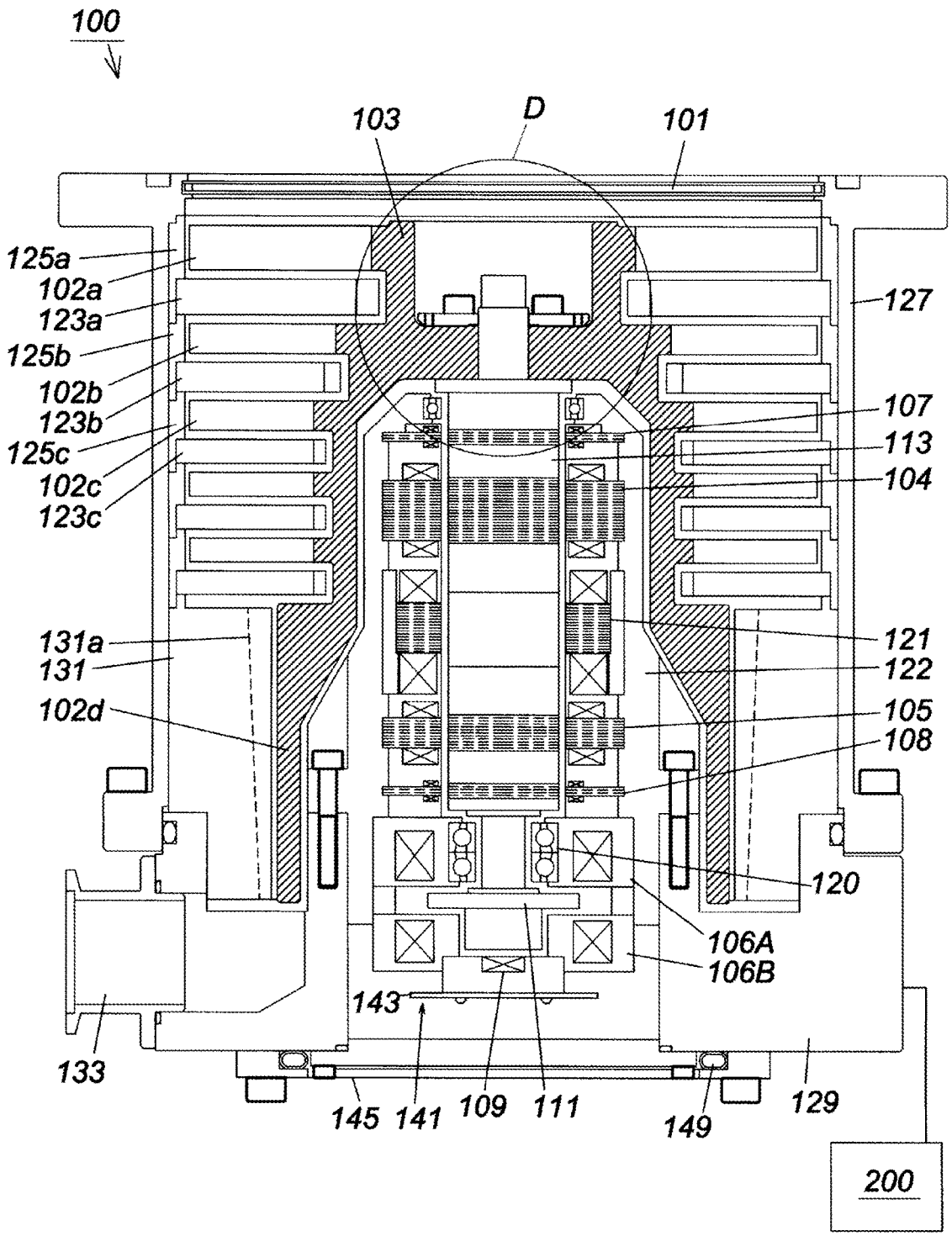
FIG. 1 is a longitudinal sectional view of a turbo-molecular pump to which a vacuum pump according to the present disclosure is applied.
Figure 2:
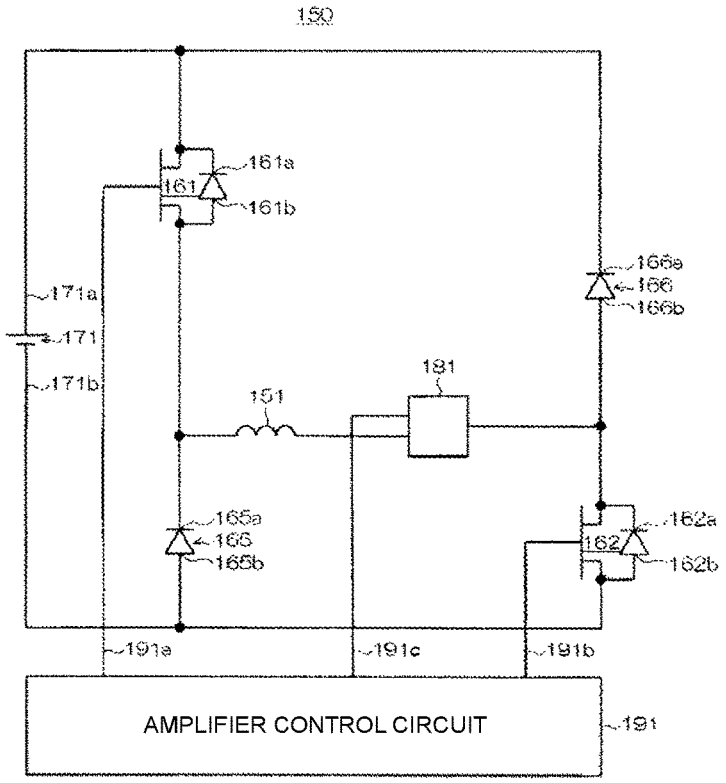
FIG. 2 is a circuit diagram of an amplifier circuit.
Figure 3:
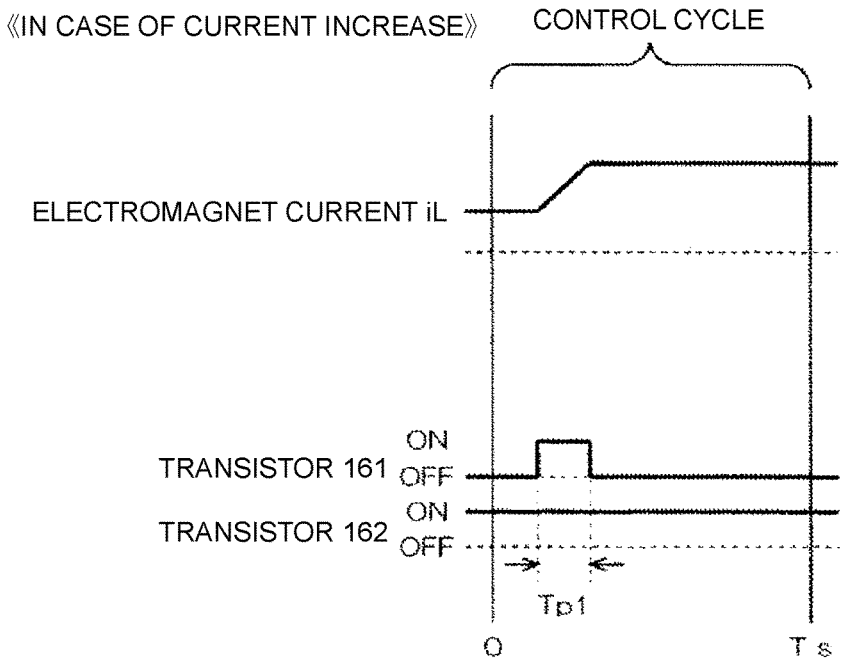
FIG. 3 is a time chart showing control in the case where a current command value is larger than a detection value.
Figure 4:
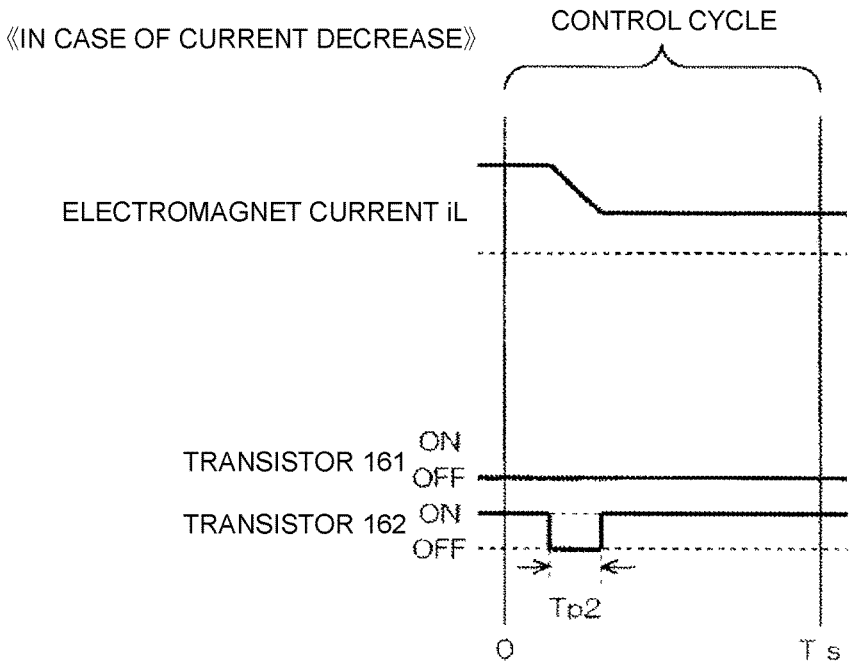
FIG. 4 is a time chart showing control in the case where the current command value is smaller than the detection value.

FIG. 1 is a longitudinal sectional view of a turbo-molecular pump to which a vacuum pump according to the present disclosure is applied, FIG. 2 is a circuit diagram of an amplifier circuit, FIG. 3 is a time chart showing control in the case where a current command value is larger than a detection value, and FIG. 4 is a time chart showing control in the case where the current command value is smaller than the detection value.

Referring to FIG. 1, in a turbo-molecular pump 100 in the drawing, an inlet port 101 is formed at an upper end of a cylindrical outer tube 127. In addition, inside the outer tube 127, a rotating body 103 in which a plurality of rotor blades 102 (102*a*, 102*b*, 102*c* . . . ) which are turbine blades for sucking and exhausting gas are formed radially in multiple tiers in a peripheral portion is provided. As a specific example of a configuration of the rotating body 103, in the turbo-molecular pump 100 in FIG. 1, such a rotating body 103 is formed into a shape in which the rotor blade 102 is formed in an outer peripheral portion of a first cylindrical portion 102*e* (see FIG. 5(*a*)).

A rotor shaft 113 is attached to the center of the rotating body 103 via a fastening portion CN, and the rotor shaft 113 is supported so as to be levitated in the air by, e.g., a five-axis control magnetic bearing and a position of the rotor shaft 113 is controlled also by the five-axis control magnetic bearing. In general, the rotating body 103 is constituted by a metal such as aluminum or an aluminum alloy.

As a specific example of a configuration of the magnetic bearing, in the turbo-molecular pump 100 in FIG. 1, upper radial electromagnets 104 are disposed such that four electromagnets are paired in an X-axis and a Y-axis. Four upper radial sensors 107 are provided so as to be close to the upper radial electromagnets 104 and correspond to the individual upper radial electromagnets 104. As the upper radial sensor 107, an inductance sensor having, e.g., a conductive winding or an eddy current sensor is used, and the upper radial sensor 107 detects a position of the rotor shaft 113 based on change of inductance of the conductive winding which changes according to the position of the rotor shaft 113. The upper radial sensor 107 is configured to detect a radial displacement of the rotor shaft 113, i.e., the rotating body 103 fixed to the rotor shaft 113, and send the radial displacement thereof to a control device 200.

In the control device 200, for example, a compensation circuit having a PID adjustment function generates an excitation control command signal of the upper radial electromagnet 104 based on a position signal detected by the upper radial sensor 107, and an amplifier circuit 150 (described later) shown in FIG. 2 performs excitation control on the upper radial electromagnet 104 based on the excitation control command signal, whereby an upper radial position of the rotor shaft 113 is adjusted.

The rotor shaft 113 is formed of a high-permeability material (iron, stainless steel, or the like), and is attracted by magnetic force of the upper radial electromagnet 104. Such adjustment is performed in an X-axis direction and in a Y-axis direction independently. In addition, a lower radial electromagnet 105 and a lower radial sensor 108 are disposed similarly to the upper radial electromagnet 104 and the upper radial sensor 107, and adjust a lower radial position of the rotor shaft 113 similarly to the upper radial position.

Further, as a specific example of a configuration of the magnetic bearing, in the turbo-molecular pump 100 in FIG. 1, axial electromagnets 106A and 106B are disposed so as to vertically sandwich a disc-shaped metal disc 111 provided below the rotor shaft 113. The metal disc 111 is constituted by a high-permeability material such as iron. A configuration is adopted in which an axial sensor 109 is provided for detecting an axial displacement of the rotor shaft 113, and an axial position signal is sent to the control device 200.

In the control device 200, for example, the compensation circuit having the PID adjustment function generates an excitation control command signal of each of the axial electromagnet 106A and the axial electromagnet 106B based on the axial position signal detected by the axial sensor 109, and the amplifier circuit 150 performs excitation control on each of the axial electromagnet 106A and the axial electromagnet 106B based on the excitation control command signals, whereby the axial electromagnet 106A attracts the metal disc 111 upward with magnetic force, the axial electromagnet 106B attracts the metal disc 111 downward, and an axial position of the rotor shaft 113 is thereby adjusted.

Thus, the control device 200 properly adjusts the magnetic force exerted on the metal disc 111 by the axial electromagnets 106A and 106B to magnetically levitate the rotor shaft 113 in an axial direction and hold the rotor shaft 113 in space in a non-contact manner. Note that the amplifier circuit 150 which performs the excitation control on the upper radial electromagnets 104, the lower radial electromagnet 105, and the axial electromagnets 106A and 106B will be described later.

In the turbo-molecular pump 100 in FIG. 1, a motor 121 includes a plurality of magnetic poles which are disposed circumferentially so as to surround the rotor shaft 113. Each magnetic pole is controlled by the control device 200 so as to rotationally drive the rotor shaft 113 via an electromagnetic force acting between the magnetic pole and the rotor shaft 113. In addition, a rotational speed sensor such as, e.g., a Hall element, a resolver, or an encoder which is not shown is incorporated into the motor 121, and a rotational speed of the rotor shaft 113 is detected by a detection signal of the rotational speed sensor.

Further, a phase sensor which is not shown is mounted in the vicinity of, e.g., the lower radial sensor 108, and is configured to detect a phase of rotation of the rotor shaft 113. The control device 200 is configured to detect a position of the magnetic pole by using detection signals of both of the phase sensor and the rotational speed sensor.

A plurality of stator blades 123 (123*a*, 123*b*, 123*c* . . . ) are provided so as to be slightly spaced from the rotor blades 102 (102*a*, 102*b*, 102*c* . . . ). Each of the rotor blades 102 (102*a*, 102*b*, 102*c* . . . ) transfers a molecule of exhaust gas downward by collision, and hence each of the rotor blades 102 is formed so as to be inclined from a plane perpendicular to an axis of the rotor shaft 113 by a predetermined angle. The stator blades 123 (123*a*, 123*b*, 123*c* . . . ) are constituted by a metal such as, e.g., aluminum, iron, stainless steel, or copper, or metals such as alloys containing these metals as ingredients.

In addition, similarly, each of the stator blades 123 is also formed so as to be inclined from the plane perpendicular to the axis of the rotor shaft 113 by a predetermined angle, and the stator blades 123 are disposed so as to extend toward an inner side of the outer tube 127 and alternate with tiers of the rotor blades 102. Further, outer peripheral ends of the stator blades 123 are supported in a state in which the outer peripheral ends thereof are inserted between a plurality of stator blade spacers 125 (125*a*, 125*b*, 125*c* . . . ) which are stacked on each other.

Each of the stator blade spacers 125 is a ring-shaped member, and is constituted by a metal such as, e.g., aluminum, iron, stainless steel, or copper, or metals such as alloys containing these metals as ingredients. The outer tube 127 is fixed to an outer periphery of the stator blade spacer 125 so as to be slightly spaced from the outer periphery thereof. A base portion 129 is disposed at a bottom portion of the outer tube 127. An outlet port 133 is formed in the base portion 129, and is caused to communicate with the outside. Exhaust gas which has entered the inlet port 101 from a side of a chamber (vacuum chamber) and has been transferred to the base portion 129 is sent to the outlet port 133.

Further, depending on usage of the turbo-molecular pump 100, a threaded spacer 131 is disposed between a portion below the stator blade spacer 125 and the base portion 129. The threaded spacer 131 is a cylindrical member constituted by metals such as aluminum, copper, stainless steel, iron, or alloys containing these metals as ingredients, and a spiral thread groove 131*a* having a plurality of threads is formed in an inner peripheral surface of the threaded spacer 131. A direction of the spiral of the thread groove 131*a* is a direction in which, when the molecule of the exhaust gas moves in a rotation direction of the rotating body 103, this molecule is transferred toward the outlet port 133. At the lowest portion of the rotating body 103 subsequent to the rotor blades 102 (102*a*, 102*b*, 102*c* . . . ), a second cylindrical portion 102*d* is disposed so as to be connected to the first cylindrical portion 102*e* and extend downward (see FIG. 2(*a*)). An outer peripheral surface of the second cylindrical portion 102*d* is cylindrical, is protruded toward the inner peripheral surface of the threaded spacer 131, and is disposed close to the inner peripheral surface of the threaded spacer 131 with a predetermined gap formed between the outer peripheral surface thereof and the inner peripheral surface thereof. The exhaust gas having been transferred to the thread groove 131*a* by the rotor blades 102 and the stator blades 123 is sent to the base portion 129 while being guided by the thread groove 131*a*.

The base portion 129 is a disc-shaped member constituting a base bottom portion of the turbo-molecular pump 100 and, in general, the base portion 129 is constituted by a metal such as iron, aluminum, or stainless steel. The base portion 129 physically holds the turbo-molecular pump 100 and also has a function of a heat conductive path, and hence it is preferable to use a metal having rigidity of iron, aluminum, or copper and having high heat conductivity.

In such a configuration, when the rotor blade 102 is rotationally driven together with the rotor shaft 113 by the motor 121, the exhaust gas is sucked from the chamber through the inlet port 101 by actions of the rotor blade 102 and the stator blade 123. The rotational speed of the rotor blade 102 is usually 20000 rpm to 90000 rpm, and a circumferential velocity at a tip of the rotor blade 102 reaches 200 m/s to 400 m/s. The exhaust gas sucked from the inlet port 101 passes between the rotor blade 102 and the stator blade 123 and is transferred to the base portion 129. At this point, a temperature of the rotor blade 102 rises due to frictional heat generated when the exhaust gas comes into contact with the rotor blade 102 and conduction of heat generated in the motor 121, and this heat is transmitted to a side of the stator blade 123 by radiation or conduction by a gas molecule of the exhaust gas.

The stator blade spacers 125 are bonded to each other at their outer peripheral portions, and transmit heat received from the rotor blade 102 by the stator blade 123 and frictional heat generated when the exhaust gas comes into contact with the stator blade 123 to the outside.

Note that, in the foregoing, the description has been made on the assumption that the threaded spacer 131 is disposed on the outer periphery of the cylindrical portion 102*d* of the rotating body 103, and the thread groove 131*a* is formed in the inner peripheral surface of the threaded spacer 131. However, reversely to this, there are cases where the thread groove is formed in an outer peripheral surface of the cylindrical portion 102*d*, and a spacer having a cylindrical inner peripheral surface is disposed around the outer peripheral surface thereof.

In addition, depending on usage of the turbo-molecular pump 100, in order to prevent gas sucked from the inlet port 101 from entering an electrical component portion constituted by the upper radial electromagnet 104, the upper radial sensor 107, the motor 121, the lower radial electromagnet 105, the lower radial sensor 108, the axial electromagnets 106A and 106B, and the axial sensor 109, there are cases where a surrounding portion of the electrical component portion is covered with a stator column 122, and a pressure in the stator column 122 is maintained at a predetermined pressure by purge gas.

In these cases, piping which is not shown is disposed in the base portion 129, and the purge gas is introduced through the piping. The introduced purge gas is sent to the outlet port 133 through gaps between a protection bearing 120 and the rotor shaft 113, between a rotor and a stator of the motor 121, and between the stator column 122 and an inner peripheral side cylindrical portion of the rotor blade 102.

Herein, the turbo-molecular pump 100 may use a control based on identification of a model and inherent parameters which are adjusted individually (e.g., various characteristics corresponding to the model). For storing the control parameters, the above-described turbo-molecular pump 100 includes an electronic circuit portion 141 in a main body of the turbo-molecular pump 100. The electronic circuit portion 141 is constituted by electronic components such as a semiconductor memory such as an EEP-ROM and a semiconductor element for accessing the semiconductor memory, and a substrate 143 for implementing the electronic components. The electronic circuit portion 141 is housed in a lower portion of a rotational speed sensor which is not shown in the vicinity of, e.g., the center of the base portion 129 constituting a lower portion of the turbo-molecular pump 100, and the lower portion is closed by a hermetic bottom lid 145.

Incidentally, in a manufacturing process of a semiconductor, some process gases introduced into a chamber have properties which make the process gases solid when pressure of the process gases becomes higher than a predetermined value or temperature of the process gases becomes lower than a predetermined value. Inside the turbo-molecular pump 100, pressure of the exhaust gas is minimized at the inlet port 101 and is maximized at the outlet port 133. When the pressure of the process gas becomes higher than a predetermined value or the temperature thereof becomes lower than a predetermined value during transfer of the process gas from the inlet port 101 to the outlet port 133, the process gas becomes solid, and is adhered to and deposited on the inside of the turbo-molecular pump 100.

For example, in the case where $SiCl_4$ is used as process gas in an Al etching device, it can be seen from a vapor pressure curve that a solid product (e.g., $AlCl_3$) is precipitated at a low degree of vacuum (760 [torr] to $10^{-2}$ [torr]) and at a low temperature (about 20 [°C.]) and the solid product is adhered to and deposited on the inside of the turbo-molecular pump 100. With this, when the precipitate of the process gas is deposited on the inside of the turbo-molecular pump 100, the deposit narrows a pump flow path and becomes a cause of a reduction in performance of the turbo-molecular pump 100. In addition, the above-described product is in a situation in which the product is easily coagulated and adhered in a portion in which pressure is high in the vicinity of the outlet port 133 or in the vicinity of the threaded spacer 131.

Accordingly, in order to solve this problem, conventionally, a heater which is not shown or an annular water cooled tube 149 is wound around an outer periphery of the base portion 129 or the like, a temperature sensor (e.g., a thermistor) which is not shown is embedded in, e.g., the base portion 129, and control of heating by the heater or cooling by the water cooled tube 149 is performed such that a temperature of the base portion 129 is maintained at a constant high temperature (set temperature) based on a signal of the temperature sensor (hereinafter referred to as TMS. TMS; Temperature Management System).

Next, with regard to the thus-configured turbo-molecular pump 100, a description will be given of the amplifier circuit 150 which performs excitation control on the upper radial electromagnets 104, the lower radial electromagnet 105, and the axial electromagnets 106A and 106B. FIG. 8 shows a circuit diagram of the amplifier circuit 150.

In FIG. 8, one end of an electromagnet winding 151 constituting the upper radial electromagnet 104 or the like is connected to a positive electrode 171*a* of a power source 171 via a transistor 161, and the other end thereof is connected to a negative electrode 171*b* of the power source 171 via a current detection circuit 181 and a transistor 162. In addition, each of the transistors 161 and 162 is a so-called power MOSFET, and has a structure in which a diode is connected between a source and a drain.

At this point, in the transistor 161, a cathode terminal 161*a* of its diode is connected to the positive electrode 171*a*, and an anode terminal 161*b* is connected to the one end of the electromagnet winding 151. In addition, in the transistor 162, a cathode terminal 162*a* of its diode is connected to the current detection circuit 181, and an anode terminal 162*b* is connected to the negative electrode 171*b*.

On the other hand, in a diode for current regeneration 165, its cathode terminal 165*a*is connected to the one end of the electromagnet winding 151, and its anode terminal 165*b* is connected to the negative electrode 171*b*. In addition, similarly to this, in a diode for current regeneration 166, its cathode terminal 166*a* is connected to the positive electrode 171*a*, and its anode terminal 166*b* is connected to the other end of the electromagnet winding 151 via the current detection circuit 181. The current detection circuit 181 is constituted by, e.g., a Hall sensor-type current sensor and an electrical resistance element.

The thus-configured amplifier circuit 150 corresponds to one electromagnet. Accordingly, in the case where a magnetic bearing is a five-axis control magnetic bearing and the total number of electromagnets 104, 105, 106A, and 106B is ten, the same amplifier circuit 150 is configured for each of the electromagnets, and ten amplifier circuits 150 are connected in parallel to the power source 171.

Further, an amplifier control circuit 191 is constituted by, e.g., a digital signal processor portion (hereinafter referred to as a DSP portion) of the control device 200 which is not shown, and the amplifier control circuit 191 is configured to switch between on/off of the transistors 161 and 162.

The amplifier control circuit 191 is configured to compare a current value (a signal in which this current value is reflected is referred to as a current detection signal 191*c*) detected by the current detection circuit 181 with a predetermined current command value. Subsequently, the amplifier control circuit 191 is configured to determine magnitudes of a pulse width (pulse width time periods Tp1 and Tp2) generated in a control cycle Ts which is one cycle by PWM control based on a comparison result. As a result, gate drive signals 191*a*and 191*b* each having this pulse width are output to gate terminals of the transistors 161 and 162 from the amplifier control circuit 191.

Note that, at the time of passage of a resonance point during acceleration operation of the rotational speed of the rotating body 103 or at the time of occurrence of disturbance during constant speed operation, it may be desirable to perform position control of the rotating body 103 at high speed with a strong force. To cope with this, a high voltage of about, e.g., 50 V is used as the power source 171 such that a sharp increase (or decrease) of a current flowing to the electromagnet winding 151 is allowed. In addition, a capacitor (depiction is omitted) is usually connected between the positive electrode 171*a* and the negative electrode 171*b* of the power source 171 for stabilization of the power source 171.

In such a configuration, a current flowing to the electromagnet winding 151 (hereinafter referred to as an electromagnet current iL) is increased when both of the transistors 161 and 162 are turned on, and the electromagnet current iL is decreased when both of the transistors 161 and 162 are turned off.

In addition, when one of the transistors 161 and 162 is turned on and the other one thereof is turned off, a so-called flywheel current is maintained. By flowing the flywheel current to the amplifier circuit 150 in this manner, it is possible to reduce hysteresis loss in the amplifier circuit 150 and suppress power consumption in the entire circuit to a low level. In addition, by controlling the transistors 161 and 162 in this manner, it is possible to reduce high frequency noise such as harmonics generated in the turbo-molecular pump 100. Further, by measuring the flywheel current in the current detection circuit 181, it becomes possible to detect the electromagnet current iL flowing in the electromagnet winding 151.

That is, in the case where a detected current value is smaller than a current command value, as shown in FIG. 3, both of the transistors 161 and 162 are turned on only once in the control cycle Ts (e.g., 100 μs) for a time period corresponding to the pulse width time period Tp1. Consequently, the electromagnet current iL during this time period is increased toward a current value iLmax (not shown) which can be flowed from the positive electrode 171*a* to the negative electrode 171*b* via the transistors 161 and 162.

On the other hand, in the case where the detected current value is larger than the current command value, as shown in FIG. 4, both of the transistors 161 and 162 are turned off only once in the control cycle Ts for a time period corresponding to the pulse width time period Tp2. Consequently, the electromagnet current iL during this time period is decreased toward a current value iLmin (not shown) which can be regenerated from the negative electrode 171*b* to the positive electrode 171*a* via the diodes 165 and 166.

In either case, after a lapse of the pulse width time period Tp1 or Tp2, one of the transistors 161 and 162 is turned on. Accordingly, during this time period, the flywheel current is maintained in the amplifier circuit 150.

Figure 5:
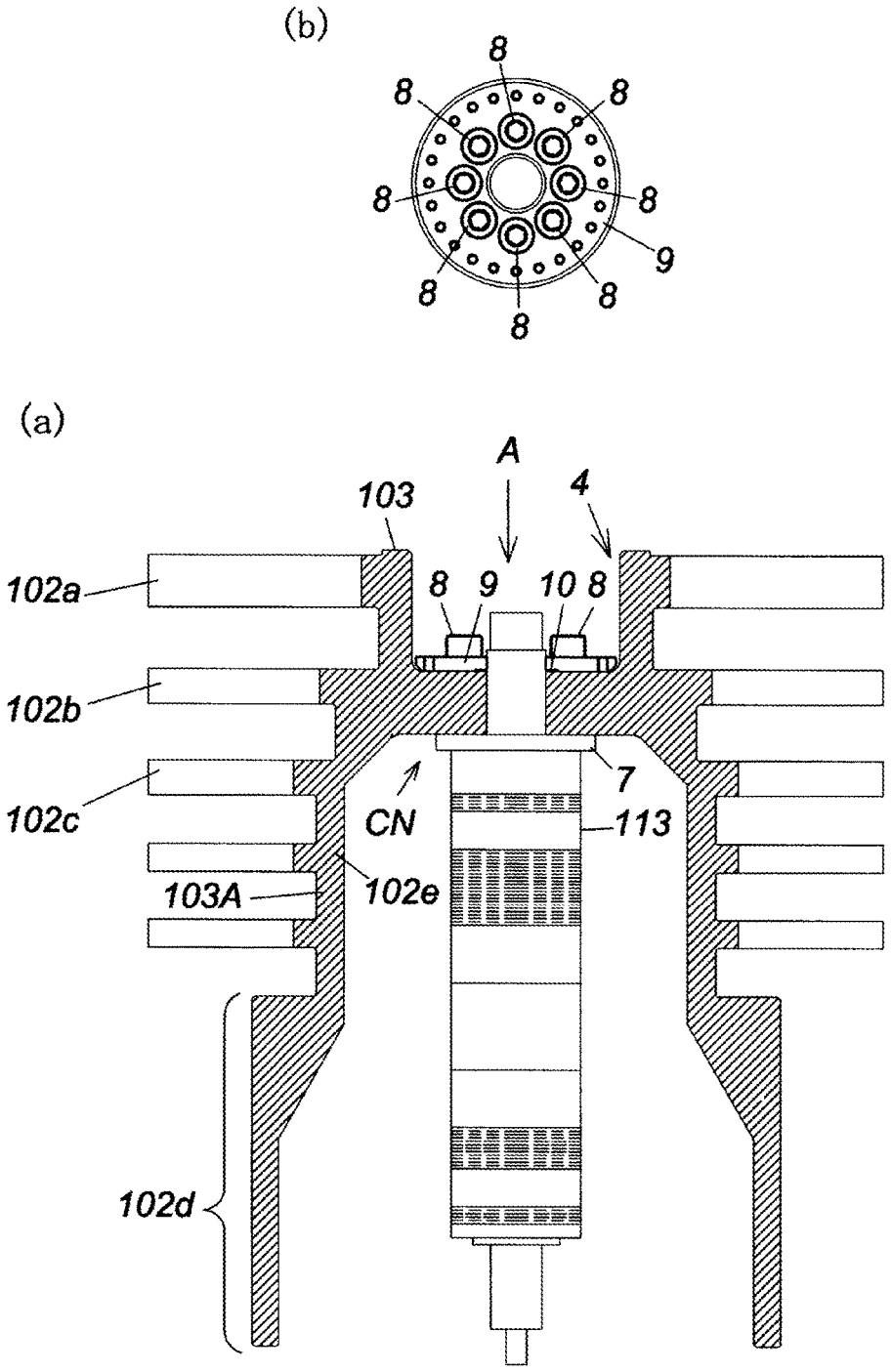
FIG. 5(*a*) is an explanatory view of a rotating body and a rotor shaft constituting the turbo-molecular pump in FIG. 1, and FIG. 5(*b*) is a view seen in the direction of an arrow A of FIG. 5(*a*).

In FIG. 5, FIG. 5(*a*) is an explanatory view of the rotating body and the rotor shaft constituting the turbo-molecular pump in FIG. 1, and FIG. 5(*b*) is a view seen in the direction of an arrow A of FIG. 5(*a*). In addition, in FIG. 6, FIG. 6(*a*) is an explanatory view of a surface treatment configuration adopted in the turbo-molecular pump in FIG. 1, FIG. 6(*b*) is an enlarged view of a B portion in FIG. 6(*a*), and FIG. 6(*c*) is an enlarged view of a C portion in FIG. 6(*a*).

Figure 6:
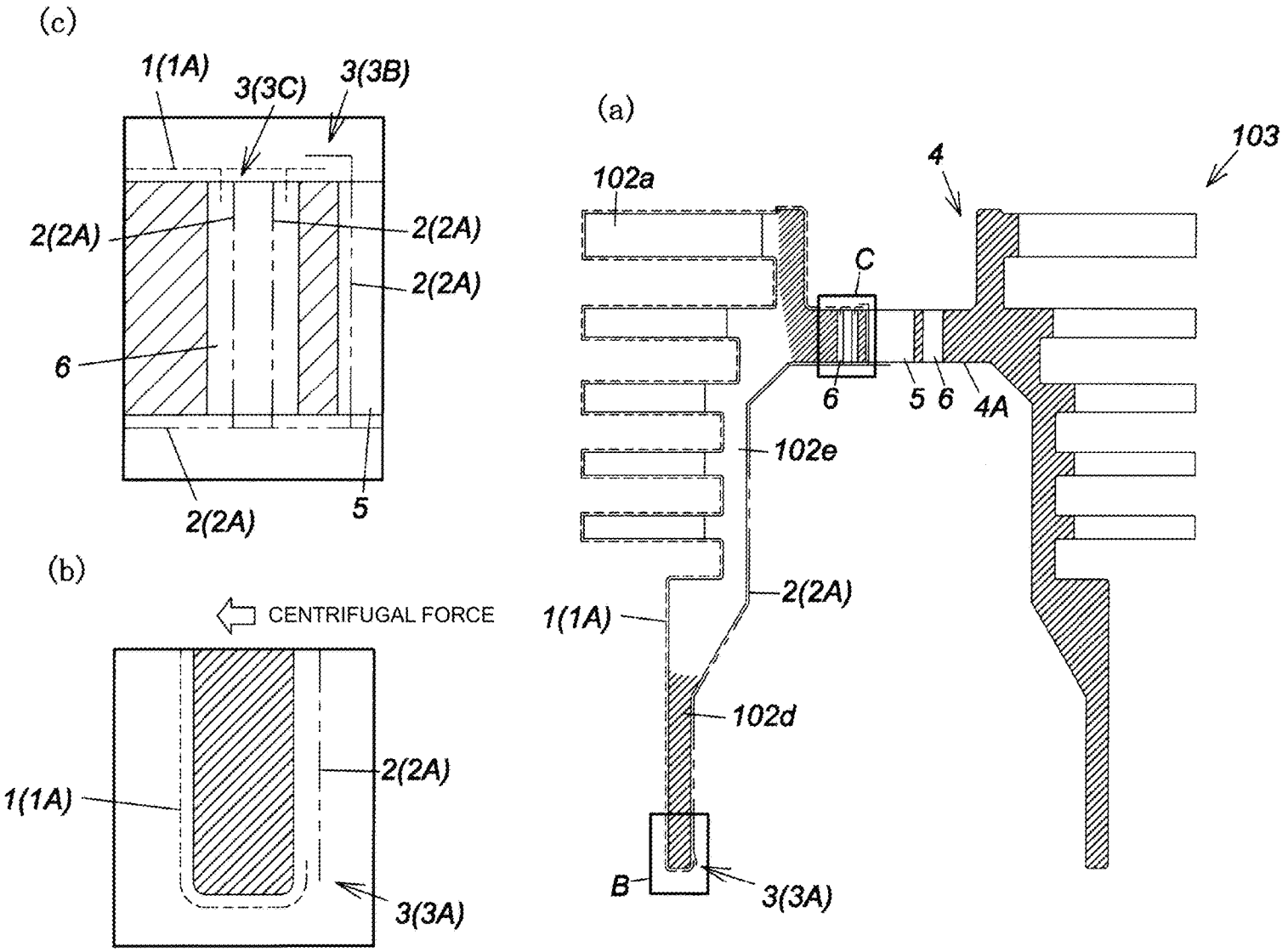
FIG. 6(*a*) is an explanatory view of a surface treatment configuration adopted in the turbo-molecular pump in FIG. 1, FIG. 6(*b*) is an enlarged view of a B portion in FIG. 6(*a*), and FIG. 6(*c*) is an enlarged view of a C portion in FIG. 6(*a*).

Referring to FIG. 6(*a*), FIG. 6(*b*), and FIG. 6(*c*), as a specific surface treatment configuration of the rotating body 103, in the turbo-molecular pump 100 in FIG. 1, the rotating body 103 has a first area 1 covered with a first surface treatment layer 1A and a second area 2 covered with a second surface treatment layer 2A on a surface of the rotating body 103, and a boundary portion 3 between the first area 1 and the second area 2 has areas 3 (3A, 3B, 3C) in which the surface treatment layers 1A and 2A of the first and second areas 1 and 2 overlap each other.

Note that, with regard to a definition of the boundary portion 3, the boundary portion 3 is used for denoting not only a boundary of each surface treatment layer but also the areas 3 in which the surface treatment layers overlap each other.

As a specific example of the first and second areas 1 and 2, in the turbo-molecular pump 100 in FIG. 1, it is assumed that the first area 1 is obtained by providing the first surface treatment layer 1A on outer surfaces of the cylindrical portions 102*d* and 102*e* and surfaces of the rotor blades 102 (102*a*, 102*b*, 102*c* . . . ), and the second area 2 is obtained by providing the second surface treatment layer 2A on inner surfaces of the cylindrical portions 102*d* and 102*e*.

Herein, "outer surfaces of the cylindrical portions 102*d* and 102*e*" includes the outer surface of the first cylindrical portion 102*d*, the outer surface of the second cylindrical portion 102*e*, a lower end surface of the second cylindrical portion 102*e*, and an inner bottom surface and an inner surface of a concave portion 4 described later.

In addition, "inner surfaces of the cylindrical portions 102*d* and 102*e*" includes the inner surface of the first cylindrical portion 102*d*, the inner surface of the second cylindrical portion 102*e*, an outer bottom surface (fastening surface 4A) of the concave portion 4 described later, an inner surface of a fitting hole 5 (a first hole on a side of the rotating body 103), and an inner surface of a through-hole 6 (a second hole on the side of the rotating body 103).

As a specific example of a configuration of the first and second surface treatment layers 1A and 2A described above, in the turbo-molecular pump in FIG. 1, a configuration is adopted in which an emissivity of the second surface treatment layer 2A is higher than that of the first surface treatment layer 1A. Accordingly, heat accumulated in the rotating body 103, specifically, the rotor blades 102 (102*a*, 102*b*, 102*c* . . . ) and the first or second cylindrical portion 102*e* or 102*d* is emitted mainly from the second surface treatment layer 2A toward a member (specifically, the stator column 122) facing the second surface treatment layer 2A.

As a means for providing the difference in emissivity described above, in the turbo-molecular pump 100 in FIG. 1, the first surface treatment layer 1A is formed with electroless nickel-phosphorus plating, and the second surface treatment layer 2A is formed by oxidizing a surface of the electroless nickel-phosphorus plating, but the difference may also be provided in the emissivity by another means different from the above means. In addition, a plating thickness, i.e., a thickness of each of the first and second surface treatment layers 1A and 2A is set to about 20 μm, but the plating thickness is not limited thereto. It is possible to appropriately change the plating thickness on an as-needed basis, and adopt a configuration in which the plating thickness of the first surface treatment layer 1A is different from that of the second surface treatment layer 2B.

Incidentally, in order to increase the emissivity of heat from the rotor blades 102 (102*a*, 102*b*, 102*c* . . . ) and prevent stress corrosion cracking of the rotor blades 102, it is desirable to form the first surface treatment layer 1A of each rotor blade 102 by oxidation of the electroless nickel-phosphorus plating similarly to the second surface treatment layer 2A. However, in the case of the turbo-molecular pump 100 in FIG. 1, from a fact that the rotor blade 102 is exposed to corrosive gas and a fact that the surface treatment layer of which an uppermost layer is constituted by an oxidized film like the second surface treatment layer 2A is easily eroded and degraded by the corrosive gas, in the turbo-molecular pump 100 in FIG. 1, the surface treatment layer (first surface treatment layer 1A) of portions in the entire rotating body 103 which are particularly exposed to the corrosive gas, specifically, the outer surfaces of the cylindrical portions 102*d* and 102*e* and the rotor blades 102 (102*a*, 102*b*, 102*c* . . . ) is formed with the electroless nickel-phosphorus plating.

Referring to FIG. 6(*a*) and FIG. 6(*b*), a first boundary portion 3 (3A) is positioned on the inner surface of the second cylindrical portion 102*d*. Further, as a specific example of a placement configuration of such a first boundary portion 3 (3A), in examples in FIG. 6(*a*) and FIG. 6(*b*), a configuration is adopted in which the first boundary portion 3 (3A) is disposed in the vicinity of an end portion of the inner surface of the second cylindrical portion 102*d*. This configuration is adopted for increasing bonding strength or peel strength between the first surface treatment layer 1A and the second surface treatment layer 2A in the boundary portion 3 (3A) by using a centrifugal force of the rotating body 103.

That is, (1) the centrifugal force of the rotating body 103 is increased in the vicinity of the end portion of the second cylindrical portion 102*d* due to a shape or a structure of the rotating body 103, and (2) in the case where the boundary portion 3 (3A) is disposed on the outer surface of the first or second cylindrical portion 102*e* or 102*d*, the centrifugal force in a direction away from the outer surface acts on the boundary portion 3, but, in the case where the boundary portion 3 (3A) is disposed on the inner surface of the first or second cylindrical portion 102*e* or 102*d* as in FIG. 6(*a*) and FIG. 6(*b*), the centrifugal force in a direction toward the inner surface acts on the boundary portion 3, whereby the boundary portion 3 (3A) is pressed toward the inner surface of the first or second cylindrical portion 102*e* or 102*d*. From this, in the examples in FIG. 6(*a*) and FIG. 6(*b*), as described above, the configuration is adopted in which the first boundary portion 3 (3A) is disposed in the vicinity of the end portion of the inner surface of the second cylindrical portion 102*d*, whereby it is made possible to effectively prevent peeling between the first surface treatment layer 1A and the second surface treatment layer 2A in the first boundary portion 3 (3A).

In addition, in the examples in FIG. 6(*a*) and FIG. 6(*b*), in order to increase an amount of radiation of heat from the rotating body 103 to a side of the stator column 122, a configuration is adopted in which, in the first boundary portion 3 (3A), by adopting a form in which the second surface treatment layer 2A is disposed so as to be placed on the first surface treatment layer 1A, a surface area of the second surface treatment layer 2A is made as large as possible. However, the form is not limited thereto. It is also possible to adopt a form in which the first surface treatment layer 1A is disposed so as to be placed on the second surface treatment layer 2A.

Figure 7:
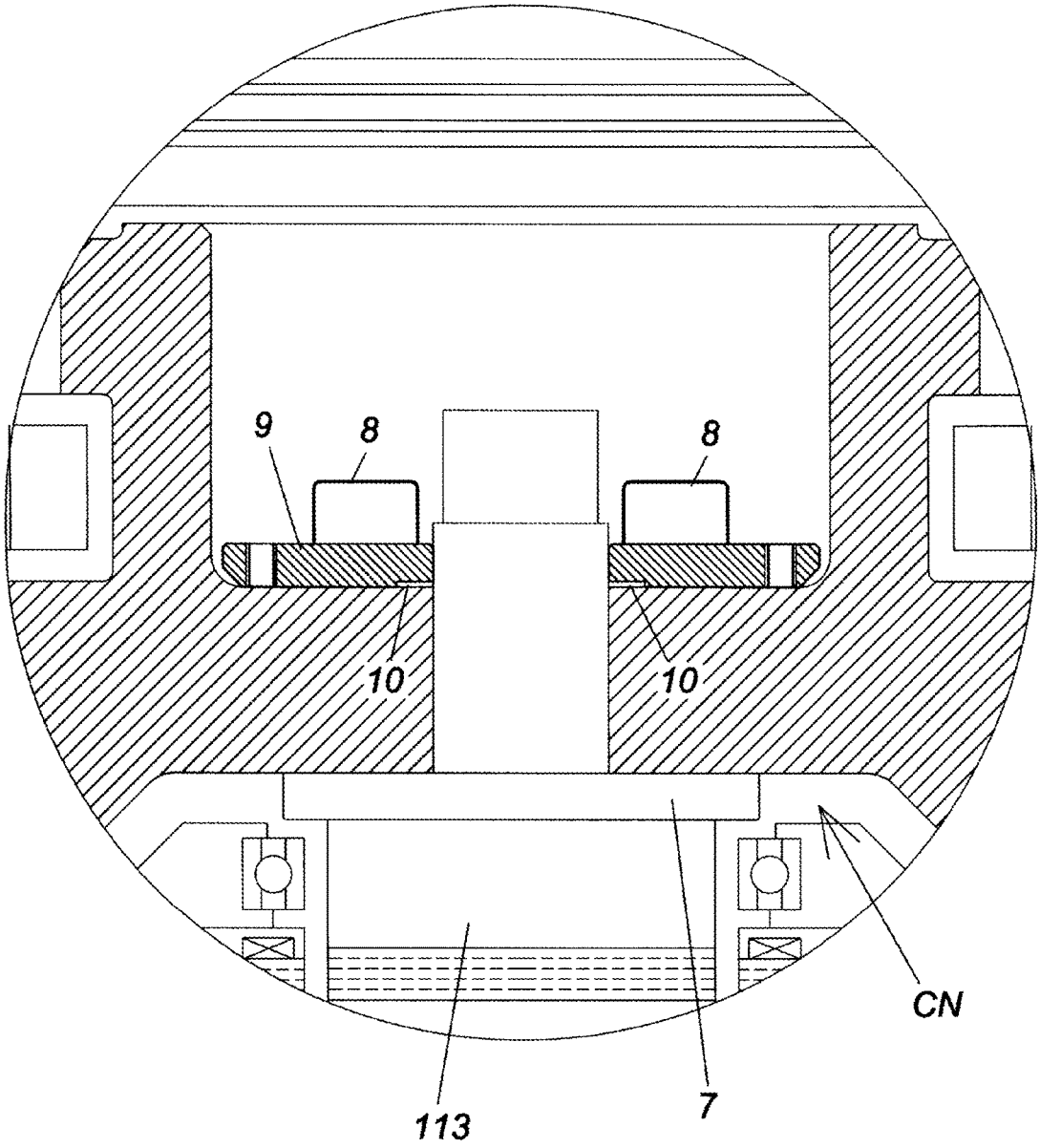
FIG. 7 is an enlarged view of a D portion in FIG. 1.

Referring to FIG. 5(*a*), FIG. 6(*a*), and FIG. 7, as a specific example of a structure of the fastening portion CN for attaching the rotor shaft 113 to the center of the rotating body 103, in the turbo-molecular pump 100 in FIG. 1, there are adopted (1) a structure in which the concave portion 4 is provided at an end portion of the rotating body 103, the fitting hole 5 is formed in a central portion of the inner bottom surface of the concave portion 4 as the first hole on the side of the rotating body 103, and a plurality of the through-holes 6, 6 . . . are formed around the fitting hole 5 as second holes on the side of the rotating body 103, (2) a structure in which the outer bottom surface of the concave portion 4 is used as the fastening surface 4A and a flange 7 facing the fastening surface 4A is formed on an outer periphery of the rotor shaft 113, (3) a structure in which a tip portion of the rotor shaft 113 is fitted in the fitting hole 5 and bolts 8 for fastening the rotating body 103 and the rotor shaft 113 to each other are fastened and fixed to threaded holes of the flange 7 which are not shown in a state in which the bolts 8 are inserted into the through-holes 6, 6 . . . , and (4) a structure in which a washer member 9 is disposed between a head portion of the bolt 8 and the flange 7.

In the fastening portion CN, as described above, the tip portion of the rotor shaft 113 is fitted in the fitting hole 5 (first hole) on the side of the rotating body 103 and, in addition, a configuration is adopted in which a second boundary portion 3 (3B) is positioned in an opening edge portion of the fitting hole 5 or a portion around the opening edge portion thereof, and the boundary portion 3 is absent on the inner surface of the fitting hole 5.

Herein, "an opening edge portion of the fitting hole 5 or a portion around the opening edge portion thereof" mentioned above denotes an area in which a member (specifically the washer member 9) facing the opening edge portion of the fitting hole 5 (first hole) or the portion around the opening edge portion thereof is in contact with the inner bottom surface of the concave portion 4. Consequently, a configuration may also be adopted in which the second boundary portion 3 (3B) is disposed in this area.

Incidentally, as another example related to a placement location of the second boundary portion 3 (3B), although depiction is omitted, it is conceivable to adopt a configuration in which the second boundary portion 3 (3B) described above is disposed on the inner surface of the fitting hole 5. However, a thickness of the second boundary portion 3 (3B) is larger than a thickness of a portion of the first surface treatment layer 1A or the second surface treatment layer 2A. Accordingly, in the configuration in which the second boundary portion 3 (3B) is disposed on the inner surface of the fitting hole 5 as described above, for example, it may be helpful to increase force for press fitting at the time of assembly or further increase a temperature difference of shrink fitting, and there is a possibility that assembly workability may be reduced. In addition, even after fitting, it may be difficult to fit the rotor shaft 113 into the fitting hole 5 with high accuracy such as tilting of the rotor shaft 113 relative to the second boundary portion 3 (3B) serving as a base point is conceivable.

However, in the turbo-molecular pump of the example of the present application shown in FIG. 1, as described above, the second boundary portion 3 (3B) is absent on the inner surface of the fitting hole 5 (first hole), and hence the second boundary portion 3 (3B) does not hinder fitting of the rotor shaft 113 into the fitting hole 5, and the turbo-molecular pump has an advantage that it is possible to fit the rotor shaft 113 into the fitting hole 5 with high accuracy.

Referring to FIG. 7 and FIG. 6(*c*), in the turbo-molecular pump of the example of the present application shown in FIG. 1, a recess portion 10 corresponding to the second boundary portion 3 (3B) is provided in a surface of a member (specifically, a lower surface of the washer member 9 which comes into contact with the inner bottom surface of the concave portion 4) facing the opening edge portion of the fitting hole 5 (first hole) or the portion around the opening edge portion thereof. The recess portion 10 may have a groove-like shape or a step-like shape.

As described above, in the second boundary portion 3 (3B), the first surface treatment layer 1A and the second surface treatment layer 2A overlap each other, and hence the thickness of the second boundary portion 3 (3B) is larger than the thickness of the portion of the first surface treatment layer 1A or the second surface treatment layer 2A. In the case where the rotating body 103 and the rotor shaft 113 are fastened to each other by the fastening portion CN without considering such a partial thickness increase, for example, the washer member 9 is disposed so as to be tilted, and a fastening state between the rotating body 103 and the rotor shaft 113 is not stabilized is conceivable. However, in the turbo-molecular pump 100 of the example of the present application shown in FIG. 1, as described above, the thickness of the second boundary portion 3 (3B) is absorbed by providing the recess portion 10 corresponding to the second boundary portion 3 (3B) and accommodating the second boundary portion 3 (3B) in the recess portion 10, and hence the fastening state between the rotating body 103 and the rotor shaft 113 is not influenced by the thickness of the second boundary portion 3 (3B), the stable fastening state is obtained, it is not necessary to strictly manage the thickness of the second boundary portion 3 (3B), and it is possible to save time and effort to perform the management.

Further, in the fastening portion CN, as described above, the tip portion of the rotor shaft 113 is fitted in the fitting hole 5 (the first hole on the side of the rotating body) and, in addition, the bolt 8 for fastening the rotating body 103 and the rotor shaft 113 to each other is inserted from the through-hole 6 (the second hole on the side of the rotating body), and a configuration is adopted in which a third boundary portion 3 (3C) is positioned on the inner surface of the through-hole 6 (see FIG. 6(*c*)). In the case of this configuration, a structure is adopted in which the third boundary portion 3 (3C) is disposed in a predetermined gap provided between a body portion of the bolt 8 and the through-hole 6. Note that, as compared with the fitting hole 5, the through-hole 6 is not a portion which requires high-accuracy dimension management, and hence, even when the third boundary portion 3 (3C) which is the overlap portion of the surface treatment layers is disposed in the through-hole 6, the third boundary portion 3 (3C) does not cause a significant problem.

Incidentally, as another example related to a placement location of the third boundary portion 3 (3C), although depiction is omitted, it is conceivable to adopt a configuration in which the third boundary portion 3 (3C) is disposed in an opening edge portion of the through-hole 6 or a portion around the opening edge portion thereof. However, in this configuration, the reduction in assembly workability and the fastening state between the rotating body 103 and the rotor shaft 113 is not stabilized similar to those in the case where the above-described recess portion 10 is not provided are conceivable. On the other hand, in the turbo-molecular pump 100 of the example of the present application shown in FIG. 1, as described above, the structure is adopted in which the third boundary portion 3 (3C) is positioned on the inner surface of the through-hole 6 and is thereby disposed in the gap between the through-hole 6 and the body portion of the bolt 8, and hence the fastening state between the rotating body 103 and the rotor shaft 113 is not influenced by the third boundary portion 3 (3C) and, also in this respect, the stable fastening state is obtained, it is not necessary to strictly manage a thickness of the third boundary portion 3 (3C), and it is possible to save time and effort to perform the management.

As has been described thus far, according to the vacuum pump and the rotating body of the vacuum pump of the present example, the configuration is adopted in which the rotating body 103 has the first area 1 covered with the first surface treatment layer 1A and the second area 2 covered with the second surface treatment layer 2A on the surface of the rotating body 103, and the boundary portion 3 between the first area 1 and the second area 2 has the area in which the surface treatment layers 1A and 2A overlap each other. Accordingly, in the respect that the base material (a metal such as aluminum or an aluminum alloy) of the rotating body 103 is not exposed in the boundary portion 3 and the exposed base material may be scarcely exposed to the corrosive gas, it is possible to effectively prevent stress corrosion cracking of the rotating body 103 and provide excellent corrosion resistance.

The present disclosure is not limited to the above-described example, and various modifications can be made by the ordinary creative ability of those skilled in the art within the scope of the technical idea of the preset disclosure.

The invention claimed is:

1. A vacuum pump exhausting gas by rotation of a rotating body, wherein:

the rotating body has, on a surface thereof, a first area covered with a first surface treatment layer and a second area covered with a second surface treatment layer, at least one boundary portion between the first area and the second area has an area in which the surface treatment layers of the first and second areas overlap each other, the rotating body is formed to have a shape in which a rotor blade is formed on an outer peripheral portion of a cylindrical portion, the rotor blade positioned at an upper end portion in an upper-lower direction of the rotating body, the at least one boundary portion is positioned on an inner surface of the cylindrical portion, and the at least one boundary portion is positioned at a lower end portion in the upper-lower direction of the rotating body.

2. The vacuum pump according to claim 1, wherein:

a rotor shaft is attached to a center of the rotating body via a fastening portion, a tip portion of the rotor shaft is fitted in a first hole on a side of the rotating body in the fastening portion, and an additional boundary portion is positioned in an opening edge portion of the first hole or a portion around the opening edge portion of the first hole.

3. The vacuum pump according to claim 2, wherein:

a recess portion corresponding to the additional boundary portion is provided in a surface of a member facing the opening edge portion of the first hole or the portion around the opening edge portion of the first hole.

4. The vacuum pump according to claim 1, wherein:

a first hole for fitting of a tip portion of a rotor shaft is provided in a center of the rotating body, and a boundary portion is absent on an inner surface of the first hole.

5. The vacuum pump according to claim 1, wherein:

a rotor shaft is attached to a center of the rotating body via a fastening portion, a bolt for fastening the rotating body and the rotor shaft to each other is inserted from a hole on a side of the rotating body in the fastening portion, and an additional boundary portion is positioned on an inner surface of the hole.

6. The vacuum pump according to claim 1, wherein:

the first area is provided on an outer surface of the cylindrical portion and a surface of the rotor blade, and the second area is provided on the inner surface of the cylindrical portion.

7. The vacuum pump according to claim 1, wherein: an emissivity of the second surface treatment layer is higher than an emissivity of the first surface treatment layer.

8. A rotating body of a vacuum pump exhausting gas, the rotating body comprising on a surface thereof:

a first area covered with a first surface treatment layer; and a second area covered with a second surface treatment layer, wherein at least one boundary portion between the first area and the second area has an area in which the surface treatment layers of the first and second areas overlap each other, the rotating body is formed to have a shape in which a rotor blade is formed on an outer peripheral portion of a cylindrical portion, the rotor blade positioned at an upper end portion in an upper-lower direction of the rotating body, the at least one boundary portion is positioned on an inner surface of the cylindrical portion, and the at least one boundary portion is positioned at a lower end portion in the upper-lower direction of the rotating body.

* * * * *